US005359774A

United States Patent [19]

Althaus

[11] Patent Number: 5,359,774

[45] Date of Patent: Nov. 1, 1994

[54] RAZOR HEAD OF A WET RAZOR

[75] Inventor: Wolfgang Althaus, Wuppertal, Germany

[73] Assignee: Warner-Lambert Company, Morris Plains, N.J.

[21] Appl. No.: 37,371

[22] Filed: Mar. 26, 1993

[30] Foreign Application Priority Data

Mar. 28, 1992 [GB] United Kingdom ..... 9206844.4

[51] Int. Cl.[5] ..... B26B 21/00; B26B 21/14; B26B 21/16

[52] U.S. Cl. ..... 30/50; 30/32; 30/41

[58] Field of Search ..... 30/32, 41, 42, 50, 43, 30/346

[56] References Cited

U.S. PATENT DOCUMENTS

| | | | |
|---|---|---|---|
| 1,633,139 | 6/1927 | Staats-Obls | 30/50 |
| 1,825,795 | 10/1931 | Haymann et al. | 30/50 |
| 3,786,563 | 1/1974 | Dorion, Jr. et al. | 30/50 |
| 4,069,580 | 1/1978 | Cartwright et al. . | |
| 4,094,066 | 6/1978 | Daniel, Jr. . | |
| 4,272,885 | 6/1981 | Ferraro | 30/50 |
| 4,407,067 | 10/1983 | Trotta | 30/50 |
| 4,409,735 | 10/1983 | Cartwright et al. . | |
| 4,443,939 | 4/1984 | Motta et al. | 30/50 |
| 4,854,043 | 8/1989 | Chen | 30/32 |
| 4,912,846 | 4/1990 | Yu . | |
| 5,036,587 | 8/1991 | Trotta et al. | 30/41 |
| 5,056,221 | 10/1991 | Thobne | 30/41 |

FOREIGN PATENT DOCUMENTS

| | | |
|---|---|---|
| 0073852 | 3/1983 | European Pat. Off. . |
| 0178066 | 4/1986 | European Pat. Off. . |
| 0389007 | 1/1987 | European Pat. Off. . |
| 0348866 | 1/1990 | European Pat. Off. . |
| 0453717 | 10/1991 | European Pat. Off. . |
| 2191459 | 2/1974 | France . |
| 2367580 | 5/1978 | France . |
| 122986 | 2/1919 | United Kingdom . |
| 219092 | 7/1924 | United Kingdom . |
| 1433594 | 4/1976 | United Kingdom . |
| 1444545 | 8/1976 | United Kingdom . |
| 2087288 | 5/1982 | United Kingdom . |

*Primary Examiner*—Richard K. Seidel
*Assistant Examiner*—Paul M. Heyrana, Sr.
*Attorney, Agent, or Firm*—Robert W. Becker & Associates

[57] ABSTRACT

A razor head having a plastic body in which is disposed a razor blade unit. The plastic body has a top cover and a front guardbar that define surface points for engaging the skin of a user. At least one of the guardbar and the top cover are provided with at least two comb-like projections.

25 Claims, 7 Drawing Sheets

RAZOR HEAD OF A WET RAZOR

BACKGROUND OF THE INVENTION

The present invention relates to a razor head, and especially a razor blade unit, disposed at the front end of a handle of a wet razor. A razor blade means in the form of a single or double razor blade is disposed in a plastic body. In the vicinity of the upper side of the razor head that defines a surface for engaging the skin of a user, comb-like projections extend toward the cutting edge(s) of the blade means.

Various embodiments of wet or safety razors are known. In each case, disposed at the front end of a handle is a razor head that carries the single or double razor blade. The razor head can be integrally formed with the handle as a molded plastic part. If the razor head is separate from the handle and is to be secured thereto in an exchangeable manner via an appropriate mechanism, it is designated as a so-called razor blade unit, with a single or double razor blade being fixedly embedded in a plastic housing.

A razor head in the form of such a razor blade unit is disclosed in EP 0389007. A wire having a number of adjacent windings is wound around the plastic body in which the double razor blade is embedded. In the vicinity of the surface of the razor blade unit that engages the skin of a user, the individual windings extend at a distance from one another and parallel to the direction of shaving, while at the underside of the plastic body the windings extend at an angle. This protective wire winding significantly improves the shaving characteristics. For example, the wire prevents the formation of folds or bulges of the skin, so that injury to the skin can also be prevented in non-visible areas. Furthermore, the wire reduces the actual shaving resistance, since it reduces the frictional forces. Finally, the protective wire prevents the user from accidentally cutting himself during improper handling of the razor blade unit at the razor blades thereof.

SUMMARY OF THE INVENTION

Unfortunately, all of these advantages achieved by the use of wires have the disadvantage that the wire is very difficult to assemble to the blade unit, which makes the blade expensive to manufacture. As a technical solution to this problem it is proposed in accordance with the present invention that the skin engaging and spacer parts of the blade unit have comb-like projections that extend toward the cutting edges. These extensions have a very similar effect to the wire strands in that the protrusion of the cutting edge is reduced at the point of the projection, which reduces the risk of cutting too close which causes redness or even nicking of the skin causing bleeding.

If a double razor blade is provided, it is proposed pursuant to a further specific embodiment that the two razor blades be secured to both sides of a spacer that is disposed between them, with the thus-formed razor blade/spacer/razor blade unit essentially being inserted from above onto a platform or support means of the plastic body. The spacer has comb-like projections extending toward the cutting edges of the blades.

In a preferred specific embodiment of this concept, the guardbar and blade platform form a lower plastic part interconnected by side walls. The blade/spacer/-blade unit is located and fixed to the lower part by means of recesses in the side walls. The top cover is then placed on top of the blades and is secured to the lower plastic part in an interlocking manner or in any other suitable fashion. The guardbar, spacer and top cover parts all have comb-like projections which are aligned with each other and provide a protection to the skin. During shaving the skin has a tendency to form bulges and folds which when out of sight of the user can cause these parts of the skin to be excessively exposed to the cutting edges of the blades. The comb-like projections prevent this from occurring and also provide an additional friction reducing effect to the razor head. This provides the combined effect of a comfortable and safe shave.

It is still important, of course, to ensure that the shave is still effective and sufficiently close. Critical to the balance between closeness and safety is the position of the blades with respect to the skin engaging surfaces, in particular the guardbar and the cover. This is dependent on three values, the protrusion, the tangent length and the shaving angle. The protrusion of each blade is the distance by which the cutting edge of each blade protrudes beyond the tangent plane formed by the skin engaging points on the guardbar and cover. The tangent length of the bottom blade is the distance between the tangent point on the guardbar and the cutting edge of the bottom blade. The tangent length of the top blade is the distance between the cutting edges of the two blades. The shaving angle is the angle between the plane of the blades and the tangent plane formed by the skin engaging points.

In a razor head according to the present invention the protrusions will have different values along the length of the blade according to the tips and troughs of the projections of the guardbar and cover parts measurement. Similarly, the tangent length of the bottom blade will vary according to tips and troughs of the guardbar. In a further embodiment of the invention it has been determined that the best balance between closeness and safety depends on controlling the two separate measurements of the protrusion and the tangent length caused by the projections. The first measurement is based on the tips of the projections, which will be referred to as the tip protrusion, and the second measurement is based on the troughs formed in between the projections, which will be referred to as the trough protrusion.

In razors according to the invention the protrusions measured based on the tips of the projections, the tip protrusion, will be in the range of minus 0.5 mm to plus 0.1 mm. The protrusion measured based on the troughs of the projections, the trough protrusion, will be in the range of minus 0.1 mm to plus 0.5 mm. The tangent length measured from the tips of the guardbar projections will be in the range of 0.5 mm to 4 mm, and measured from the troughs of the guardbar projections it will be in the range of 1 mm to 6 mm.

BRIEF DESCRIPTION OF THE DRAWINGS

This objective, and other objectives and advantages of the present invention, will appear more clearly from the following specification in conjunction with the accompanying schematic drawings, in which.

DESCRIPTION OF PREFERRED EMBODIMENTS

Figure 1:
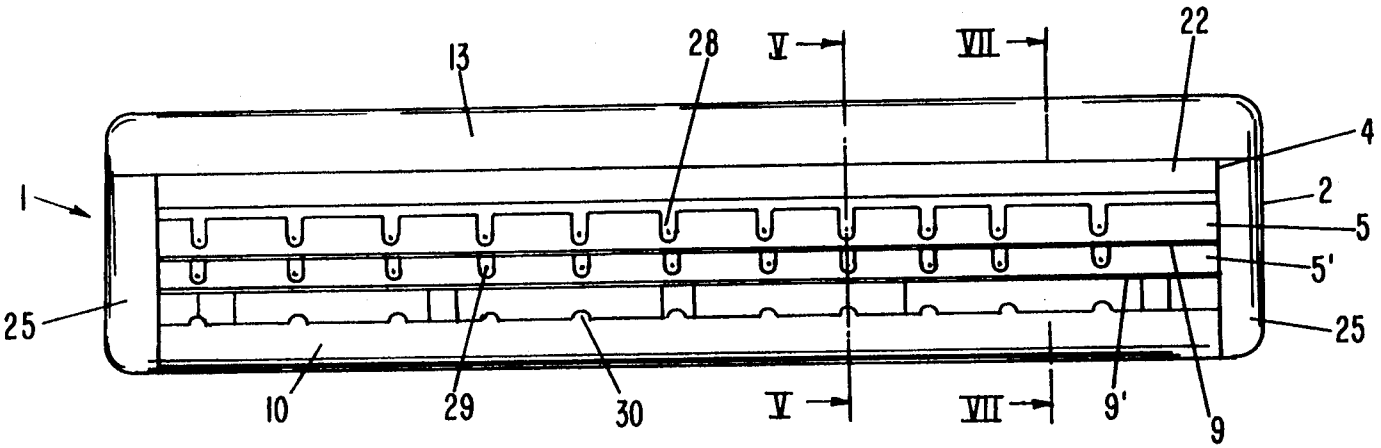
FIG. 1 is a top view of one exemplary embodiment of the inventive razor head in the form of a razor blade unit of a wet razor.
Figure 2:
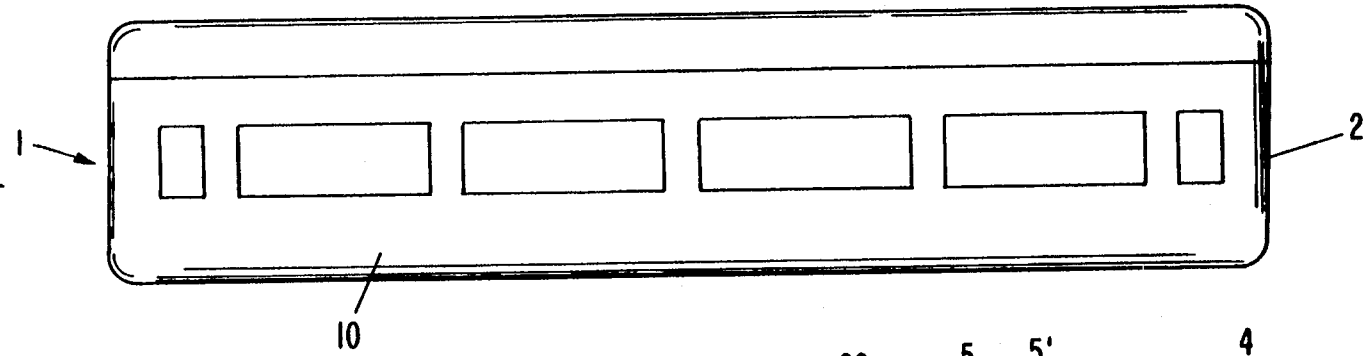
FIG. 2 is a bottom view of the razor blade unit of FIG. 1.
Figure 3:
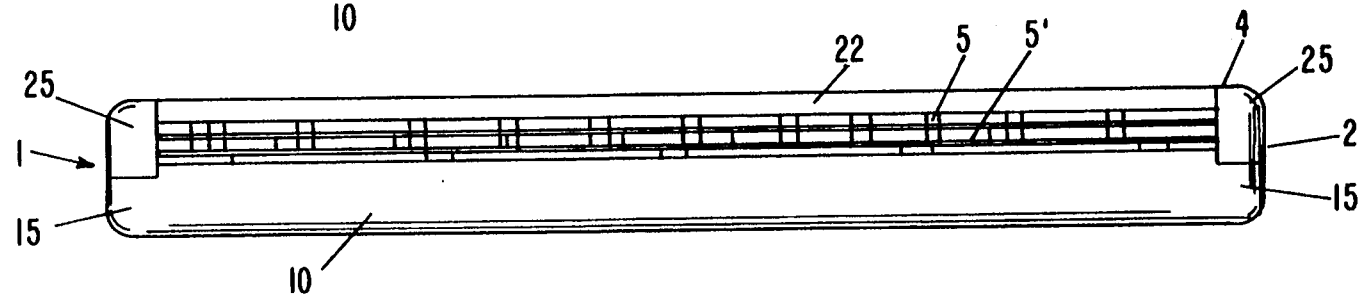
FIG. 3 is a front view of the razor blade unit of FIG. 1.

Referring now to the drawings in detail, the illustrated razor head, which is in the form of a so-called razor blade unit for a wet or safety razor, and which can be secured to the front end of a non-illustrated handle, comprises a plastic body 1 in which are disposed two razor blades 5 and 5', the cutting edges 9 and 9' of which extend parallel to one another and are offset one behind the other.

The plastic body 1 comprises a base member 2 that is provided with the razor blades 5, 5', as well as a top cover 4 that is placed upon the base member 2.

Figure 5:
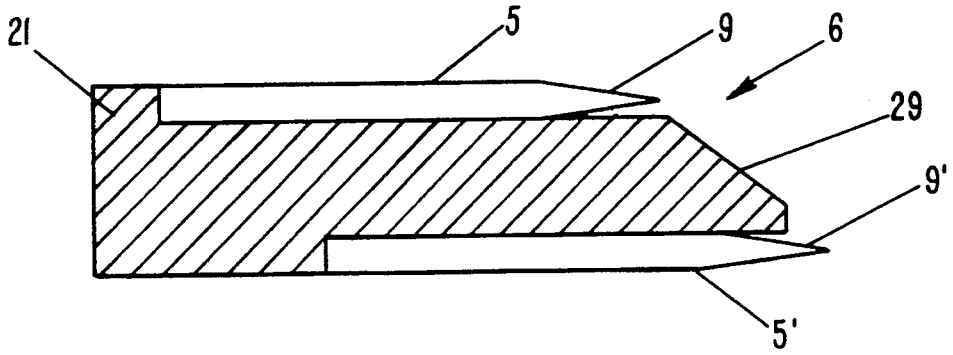
FIG. 5 is an enlarged cross-sectional view of the blade/spacer/blade unit taken along the line V—V in FIG. 1.
Figure 6:
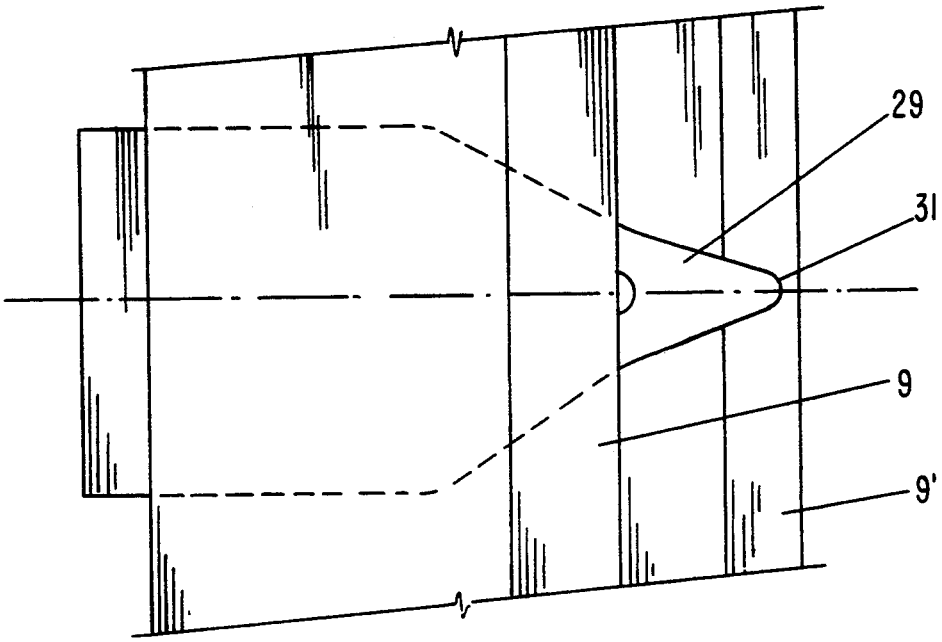
FIG. 6 is an enlarged part top view of the blade/spacer/blade unit showing a further embodiment of the projections.

On the upper side, the base member 2 defines a platform or support means for the razor blades 5, 5'. For this purpose, a spacer 21 is sandwiched between the two razor blades 5, 5', which are securely connected to the spacer 21 . These components thus form a razor blade/spacer/razor blade unit 6 (FIG. 5), which is placed from above upon the support means of the base member 2. For this purpose, the spacer 21 comprises projections (not shown) extending from the rear and each end of the spacer 21 which are received in recesses (not shown) in the sides 25 of the base member 2. The projections at each end of the spacer 21 serve to locate the blade/spacer/blade unit accurately with respect to the base member 2 and correspondingly to the skin engaging surfaces. It will be appreciated that the blades can be accurately located with respect to the base member by any number of known ways. The base member 2 also comprises a front guardbar 10 that extends parallel to the blades 5, 5'.

The cover 4 is provided at the top with a convexly curved glide or antifriction strip 22 which is convexly curved so that it extends partially over the back wall of the plastic body 1. The particular advantage of this glide strip 22 is that it is also more effective at the end of the razor blade unit. When shaving, the skin is made taut and is pressed in and a bulge is formed at the end of the razor blade unit. Thus, the curved glide strip 22 glides better in this region and thus produces a more comfortable shave.

Figure 4:
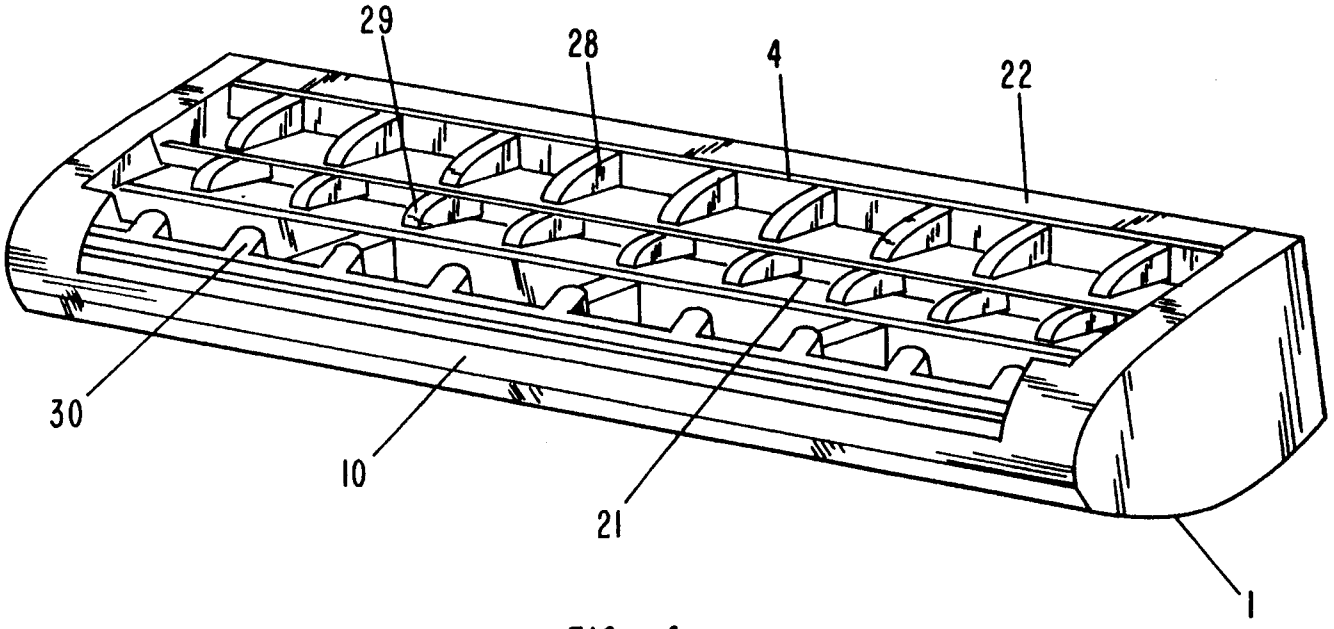
FIG. 4 is a perspective view of one exemplary embodiment of the inventive razor head.
Figure 7:
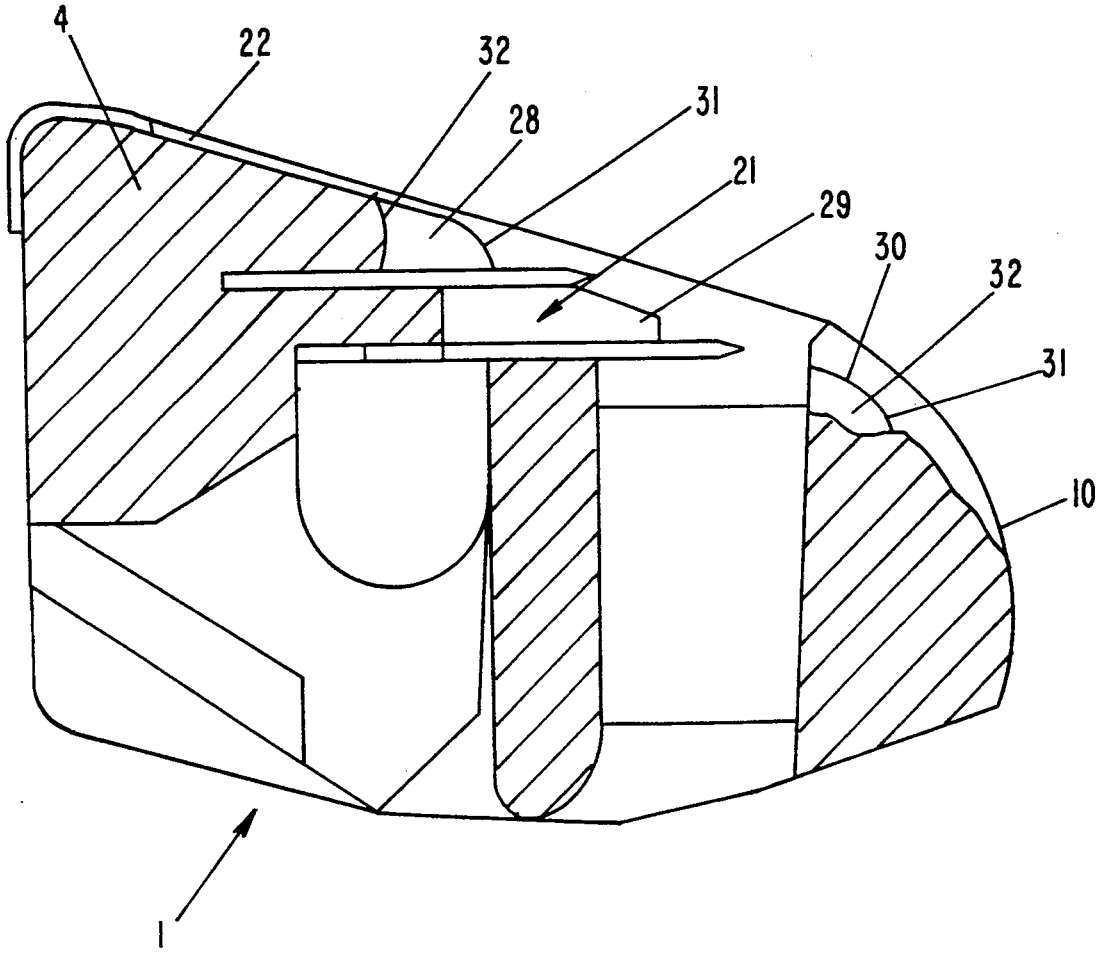
FIG. 7 is an enlarged cross-sectional view of the razor blade unit of FIG. 1 taken along the line VII—VII.
Figure 7A:
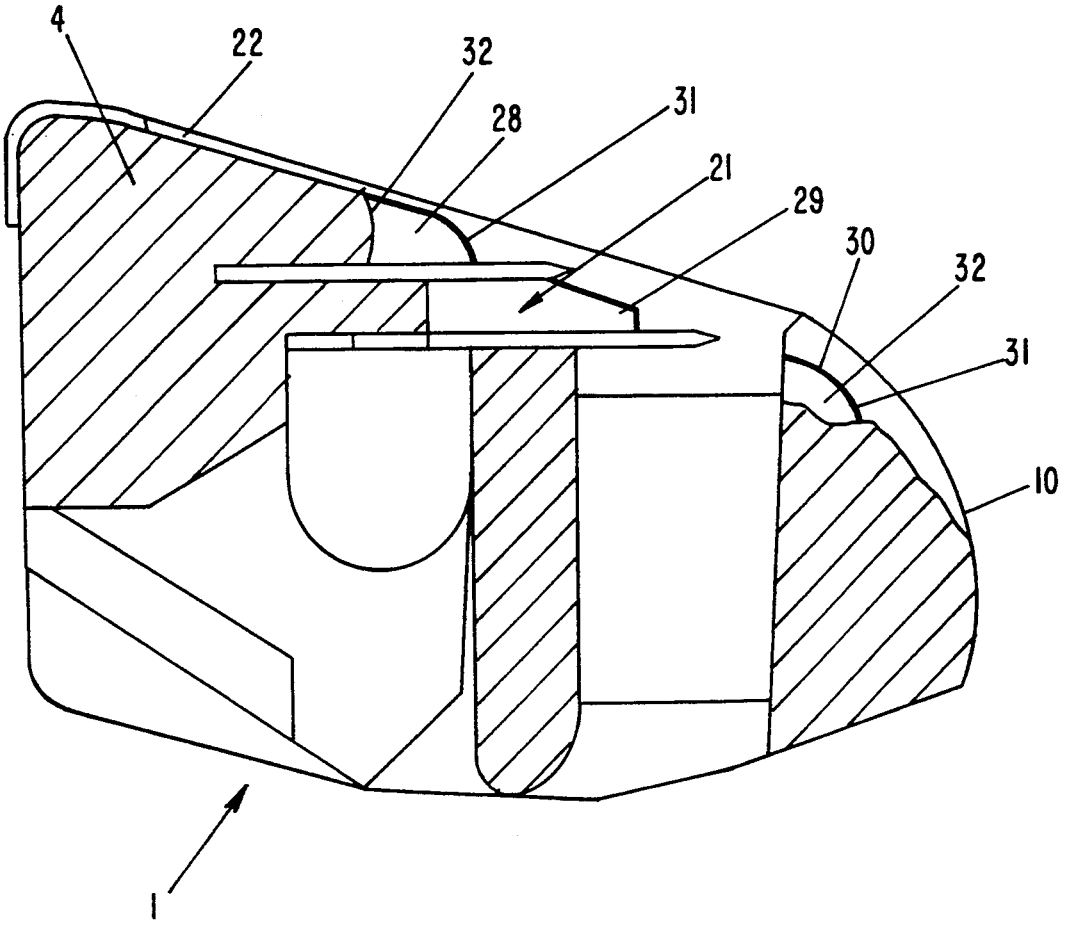
FIG. 7*a* shows the friction reducing coating of the comb-like projections.

As best shown in FIG. 4, the forward guardbar 10 and the top cover 4 are both provided with projecting comb-like projections 30, 28 that extend perpendicular to the blades and are aligned with each other. The spacer 21 is provided with similar comb-like projections 29. All of the comb-like projections on the guardbar 10, cover 4 and spacer 21 have a rounded tip 31 at the end of the projection. Various curvatures and shapes can be used on the ends of the tips to provide the best shaving comfort. A rounded trough 32 (FIG. 7) is provided at the base of the comb-like projections 30, 28, 29 where they are Joined to the respective guardbar 10, cover 4 and spacer 21 parts. The preferred shape of the tips 31 and troughs 32 is rounded side surfaces and rounded uppermost surfaces forming a smooth spherical surface.

Figure 8:
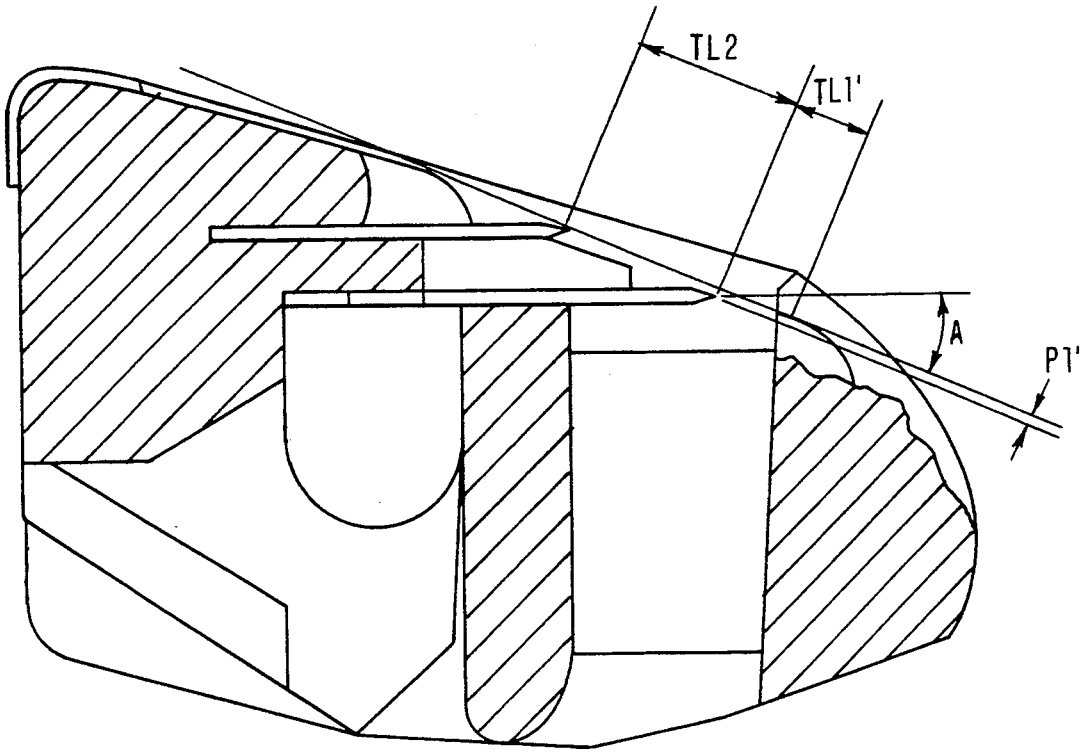
FIG. 8 is the same view as FIG. 7 showing the shaving geometry at the tips of the projections.
Figure 9:
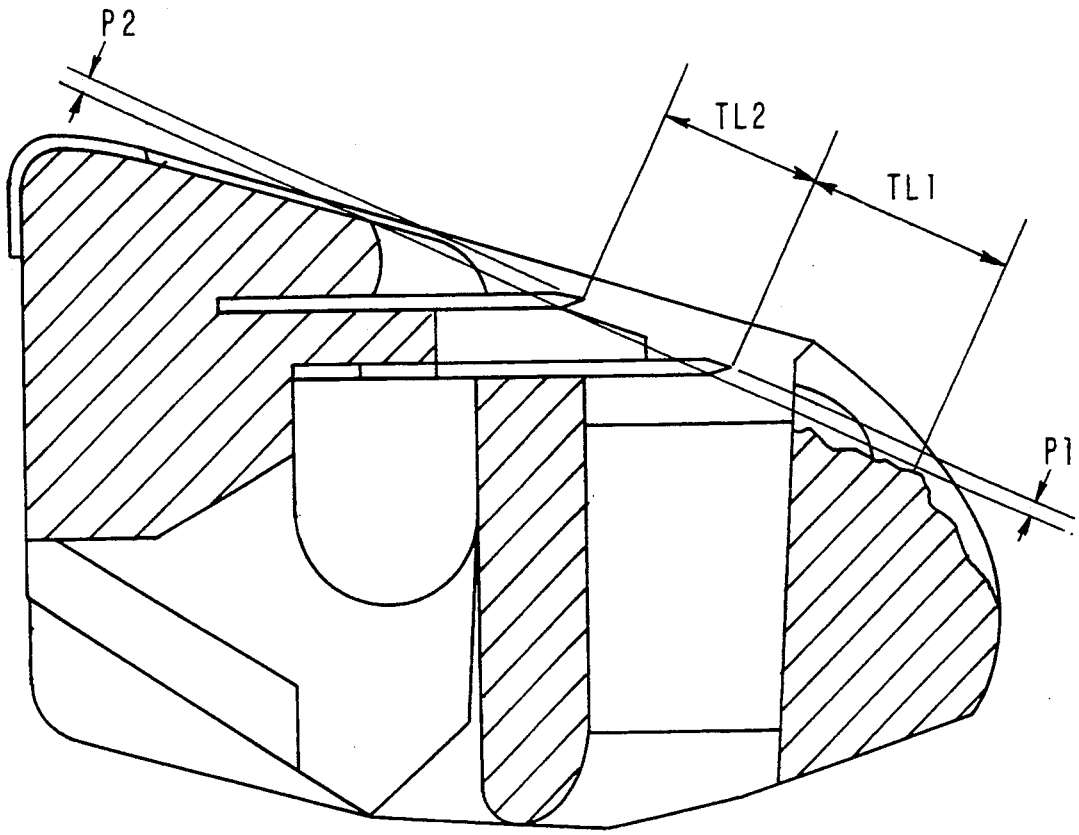
FIG. 9 is the same view as FIG. 7 showing the shaving geometry at the troughs of the projections.

As shown in FIGS. 8 and 9, the blades are fixed at a certain shaving angle A with respect to the skin engaging parts of the razor head and each blade has a certain protrusion P and a tangent length TL. The shaving angle A is the angle between the plane of the blades and the tangent connecting the guardbar 10 and the top cover 4. In the illustrated embodiment the shaving angle can be between 15° and 30°.

The protrusion of the bottom and top blades P1 and P2 is the distance by which the respective blade extends beyond the tangent plane connecting the guardbar 10 and the top cover 4. The tangent length TL1 of the bottom blade 5' is the distance between the tangent point on the guardbar and the cutting edge 9'. The tangent length TL2 of the top blade 5 is the distance between the cutting edge 9' and the cutting edge 9.

At the tip 31 of each of the comb-like projections 28, 29, 30 both the protrusions and the tangent length TL1 of the bottom blade will be much less than at the trough 32. The blade unit in the illustrated embodiment has trough protrusions P1 and P2 measured at the troughs 32 of each of the skin engaging surfaces of 0.07 mm, and tip protrusions P1' and P2' of 0 mm at the tips 31 of the comb-like projections 28, 29, 30. Successful shaves have also been achieved for particularly heavy beards with trough protrusions P1 and P2 of 0.1 mm or higher and tip protrusions P1' and P2' of −0.1 mm.

In the illustrated embodiment the tangent length TL1 measured at the troughs 32 of the guardbar projections and the tangent length TL1' measured at the tips 31 of the guardbar projections 30 are both 1.5 mm. Successful shaves have also been achieved for particularly heavy beards with a trough tangent length TL1 of 2.5 mm and a tip tangent length TL1' of 0.5 mm.

It will be understood that the razor head may take many forms other than the one described. For example, the protrusions P1, P2 and P1', P2' could have different values. Also, the second or additional blades could be set at a different angle to the first blade. The projections 28, 29, 30 need not be aligned with each other; one of more of them could be out of line.

The projections 28, 29, 30 are spaced a preferred distance apart and will be of a preferred thickness in order that the objectives of comfort, safety and closeness are achieved. The preferred spacing is at least 2 mm and the preferred thickness is at least 0.2 mm.

The projections 28, 29, 30 are typically made from a single piece plastic part but can also be made from a metal part which has a lower frictional resistance. Alternatively or additionally, the projections 28, 29, 30 are preferably coated with a friction reducing coating such as a polyvinyl pyrrollidone/polyurethane (PVP/PE) mixture.

The present invention is, of course, in no way restricted to the specific disclosure of the specification and drawings, but also encompasses any modifications within the scope of the appended claims.

What I claim is:

1. A razor head, comprising:

a plastic body, with a razor blade means having at least one cutting edge being disposed in said plastic body, which plastic body includes a top cover and a front guardbar that define surface means for engaging the skin of a user, and with both said guardbar and said top cover each being provided with at least two comb-like projections, wherein said comb-like projections are spaced at least 2 mm from one another and have a thickness of at least 0.2 mm, wherein said at least one cutting edge of said razor blade means has a protrusion at a trough of said comb-like projections that is at the least minus 0.1 mm and at most 0.5 mm, and wherein said at least one cutting edge has a protrusion at a tip of said comb-like projections that is at the least minus 0.5 mm and at most 0.1 mm.

2. A razor head according to claim 1, wherein said razor blade means comprises two razor blades that are disposed on opposite sides of a spacer that is disposed between said blade, and wherein said spacer is also provided with comb-like projections.

3. A razor head according to claim 2, wherein all of said comb-like projections extend perpendicular to said at least one cutting edge of said razor blade means.

4. A razor head according to claim 2, wherein said top cover is provided with comb-like projections that are aligned with comb-like projections of at least one of said spacer and said guardbar.

5. A razor head according to claim 2, wherein each of said comb-like projections has a tip portion at a free end thereof and has a trough portion at a base thereof where said comb-like projection joins its respective top cover, spacer, or guardbar.

6. A razor head according to claim 5, wherein said at least one cutting edge of said razor blade means has a trough protrusion that is at the least minus 0.1 mm and at most 0.5 mm.

7. A razor head according to claim 6, wherein each of said razor blades has a cutting edgem with the trough protrusion of one of said cutting edges being negative while the trough protrusion of the other cutting edge is positive.

8. A razor head according to claim 6, wherein said trough protrusion of said at least one cutting edge is at least 0.02 mm.

9. A razor head according to claim 5, wherein each of said razor blades has a cutting edge, with a tangent length of at least one of said cutting edges being at least 0.5 mm and at most 6 mm.

10. A razor head according to claim 9, wherein a tangent length from one of said cutting edges to said tip portions of said comb-like projections of said Guardbar is at least 0.5 mm.

11. A razor head according to claim 9, wherein a tangent length from one of said cutting edges to said trough portions of said comb-like projections of said guardbar is at most 6 mm.

12. A razor head according to claim 5, wherein at least one of said tip portions and said trough portions of said comb-like projections of at least one of said top cover, said spacer, and said guardbar are rounded on an uppermost surface thereof.

13. A razor head according to claim 5, wherein at least one of said tip portions and said trough portions of said comb-like projections of at least one of said top cover, said spacer, and said guardbar are rounded on side surfaces thereof.

14. A razor head according to claim 5, wherein said tip portions and said trough portions of said comb-like projections of said top cover, said spacer, and said guardbar are rounded on uppermost and side surfaces thereof.

15. A razor head according to claim 2, wherein at least one of said top cover, said spacer, and said guardbar is provided with comb-like projections that are spaced at least 2 mm from one another and have a thickness of at least 0.2 mm.

16. A razor head according to claim 15, wherein said comb-like projections are spaced at least 4 mm from one another and have a thickness of at least 0.5 mm.

17. A razor head according to claim 2, wherein said comb-like projections of said top cover, said spacer, and said guardbar are made of plastic.

18. A razor head according to claim 2, wherein said comb-like projections of said top cover, said spacer, and said guardbar are made of metal.

19. A razor head according to claim 2, wherein said comb-like projections of said top cover, said spacer, and said guardbar are coated with a friction reducing coating.

20. A razor head according to claim 2, which has a shaving angle between 15° and 30°.

21. A razor head according to claim 20, wherein the shaving angle of one of said blades is different from the shaving angle of the other of said blades.

22. A razor head according to claim 2, wherein said .top cover is provided with a glide strip.

23. A razor head according to claim 22, wherein said glide strip is convexly curved.

24. A razor head, comprising:

a plastic body, with a razor blade means having at least one cutting edge being disposed in said plastic body, which plastic body includes a top cover and a front guardbar that define surface means for engaging the skin of a user, and with both said guardbar and said top cover each being provided with at least two comb-like projections, wherein said comb-like projections of said guardbar on the one hand and of said top cover on the other hand are directed in opposite directions and face one another.

25. A razor head, comprising:

a plastic body, with a razor blade means having at least one cutting edge being disposed in said plastic body, which plastic body includes a top cover and a front guardbar that define surface means for engaging the skin of a user, said razor blade means comprising two razor blades that are disposed on opposite sides of a spacer that is disposed between said blades, wherein said guardbar, said top cover and said spacer are each provided with at least two comb-like projections, and wherein all of said comb-like projections extend perpendicular to said at least one cutting edge of said razor blade means.

* * * * *